US005402119A

United States Patent [19]

Feierstein

[11] Patent Number: 5,402,119

[45] Date of Patent: Mar. 28, 1995

[54] MULTIPLE-INPUT AIRCRAFT ANNUNCIATOR SYSTEM

[75] Inventor: Alan Feierstein, Essex Fells, N.J.

[73] Assignee: Delta Aerosystems, Inc., Essex Fells, N.J.

[21] Appl. No.: 36,288

[22] Filed: Mar. 24, 1993

[51] Int. Cl.[6] ..... G08B 21/00

[52] U.S. Cl. ..... 340/945; 340/946; 340/661

[58] Field of Search ..... 340/945, 946

[56] References Cited

U.S. PATENT DOCUMENTS 3,641,546 2/1972 Blackburn .
3,739,376 6/1973 Keledy .

*Primary Examiner*—John K. Peng
*Assistant Examiner*—Benjamin C. Lee
*Attorney, Agent, or Firm*—Bryan, Levitin & Bab

[57] ABSTRACT

Aircraft systems and sensors are monitored by pre-wiring a plurality of mating connectors to each system. Each mating connector has a positive voltage pin, a zero voltage pin and a reference pin. For those systems and sensors that emit zero voltage, the system is connected to the positive voltage pin while a jumper is used to connect the zero voltage pin to the reference voltage pin. For those systems emitting positive voltage, the system is connected with the zero voltage pin while a jumper is used to connect the positive voltage pin to the reference voltage pin. For each system or sensor monitored, there is a voltage comparator having both a positive and a negative input connected with a rear-mounted connector for connection with the pre-wired mating connectors. The rear-mounted connectors have identical pin arrangements with the mating connector for proper connections. A reference voltage which is approximately one-half of the operating voltage of the aircraft is channeled through the annunciator system from a rechargeable power source. By connecting the connectors by matching their respective pins, an alert signal can be monitored by the comparators.

9 Claims, 4 Drawing Sheets

MULTIPLE-INPUT AIRCRAFT ANNUNCIATOR SYSTEM

FIELD AND BACKGROUND OF THE INVENTION

The present invention relates in general to electrical comparators and in particular to a central annunciator system for monitoring the status of various avionics systems and other aircraft sensors using such comparators.

Many aircraft systems and sensors require frequent monitoring or scanning by the pilot in order to detect potential problems. Large aircraft such as jet transports have built-in annunciator panels which provide automated scanning. Smaller aircraft, however, do not provide for automated scanning causing the pilot to often sacrifice his continuous physical scanning in order to conduct other necessary tasks.

Annunciator systems that are commonly found in the aircraft field provide for devices such as comparators that are used for monitoring input such as voltages.

U.S. Pat. No. 4,996,520 provides for an over-voltage detection test apparatus for military aircraft weapon systems using an electrical connector for interfacing the test apparatus with an aircraft power supply and an electrical comparator that can pass the voltages from first and second inputs. The first input is clamped to a voltage which is representative of the maximum voltage limit of the missiles of the aircraft. The second input is tied to the output of the aircraft power supply so as to vary with the power supply output. An alarm circuit is activated by the comparator when the second input voltage exceeds the first input voltage thus warning the operator of over-voltage conditions. The test apparatus is very complex and directed specifically to the F-16 fighter aircraft and its missile functions.

U.S. Pat. No. 3,641,546 for a high-low voltage level sensor uses a pair of comparators for monitoring voltage levels. Two comparators are used to monitor a single input, particularly, the voltage. High and low level voltages monitored by the comparator produce a signal that is used to energize an alarm device. The sensor cannot be customized and the alarm device must be terminated by disconnecting the input or turning off the unit entirely.

U.S. Pat. No. 3,789,242 is for an over-voltage and undervoltage detection circuit having a voltage comparator. The voltage comparator uses multiple reference voltage sources and is not suitable for multiple-input monitoring.

The annunciator systems found in the prior art employ separate alarm circuits for each function monitored. Thus, in a multiple-function arrangement, multiple alarm circuits would add a great deal of circuitry to the system and prove to be very costly.

It is known in the prior art to customize the inputs in a comparator through the use of internal switches or jumpers. These parts commonly used for customization are costly, require precious space and require either a hole or opening in the comparator box in order to allow sufficient access for customization. Moreover, it is not desirable to open a box in order to customize the comparator devices.

At present, there is no known central annunciator device that can be adapted to a wide variety of existing aircraft. Additionally, there is no known annunciator device that provides for a customizable unit, a distraction-free unit, a low-cost unit, an easy-installable unit, an interference-free unit, a fail-safe unit, a self-powered unit, and a multiple alert handling capability unit.

SUMMARY OF THE INVENTION

The present invention uses comparators to monitor the output voltage of the various systems and sensors for an aircraft. The present invention allows for the systems and sensors of the aircraft to be pre-wired to connectors. The present invention provides for an annunciator system or circuit using a plurality of comparators which are connected each to a rear-mounted connector. The pre-wired connectors or mating connectors are detachably connected to a corresponding rear-mounted connector connected to a comparator. Each comparator is connected in a circuit for activating both an audio and a visual alarm for alerting the operator of the aircraft.

An object of the present invention is to provide an annunciator system that is adaptable to different electrical standards of various model aircraft and avionics for customizing purposes.

Another object of the present invention is to provide an annunciator system that is compact and can be accommodated in a cockpit of an aircraft.

Another object of the present invention is to provide an annunciator system that is low cost and easy to install.

Another object of the present invention is to provide an annunciator system that does not interfere with communications which is commonly found in microprocessor-based units.

Another object of the present invention is to provide an annunciator system that is fail-safe in that a failure in the system will not affect the systems or sensors of the aircraft in any way.

Another object of the present invention is to provide an annunciator system that is self-powered and can detect a power problem with the aircraft and warn the operator in sufficient time.

Another object of the present invention is to provide an annunciator system that can handle multiple alerts caused by numerous systems of the aircraft without distracting the operator or causing the operator to terminate the annunciator system.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

The present invention takes advantage of the fact that aircraft alert signals are configured in one of two ways. Either the signals are normally grounded and emit a positive voltage for indicating an alert (a positive sensor), or the signals are at a certain positive voltage, typically the voltage of the aircraft which is usually positive 12 or 24 volts, such that the positive voltage will drop to ground or zero voltage indicating an alert (a ground sensor).

Figure 6:
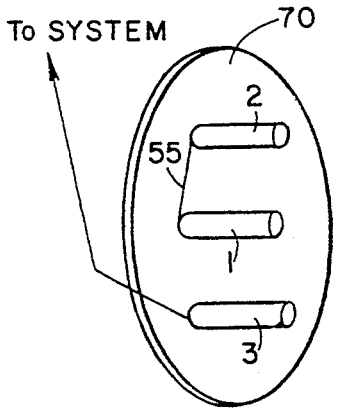
FIG. 6 is a perspective view of the mating connector of FIG. 5.

The present invention allows for the monitoring of multiple input signals from the systems or sensors of an aircraft (collectively called sensors herein). FIG. 6 illustrates a mating connector 70 of the present invention, having a positive voltage pin 2 and a negative or zero voltage pin 3 (here referred to as a ground voltage pin). Reference voltage pin 1 accompanies pin 2 and pin 3 in a triangular arrangement, with each pin being fixed at a different apex of the triangular arrangement as shown in FIG. 6. Reference voltage pin 1 is for carrying a reference voltage which is channeled through the present invention.

The present invention allows an aircraft to be customized for monitoring the various systems and sensors by pre-wiring the mating connector 70 with pins 1 and 3 to the systems of the aircraft. If the aircraft system emits a positive voltage signal for indicating an alert, then the negative or zero voltage pin 3 is connected to the positive voltage of the system. The connection from pin 3 to the system can be made through a high-volume resistor (see FIG. 2) which isolates the circuitry from the aircraft. A jumper or connection wire 55 is used to connect the reference pin 1 to the positive voltage pin 2. The reference voltage channeled through reference voltage pin 1 is approximately one-half of the operating voltage of the aircraft. These mating connectors will be referred to as positive mating connectors.

For those systems providing no voltage or ground indicating an alert, the system is connected to the positive voltage pin 2 and the reference pin 1 is connected by jumper 55 with zero voltage pin 3. These mating connectors will be referred to as ground mating connectors.

Figure 1:
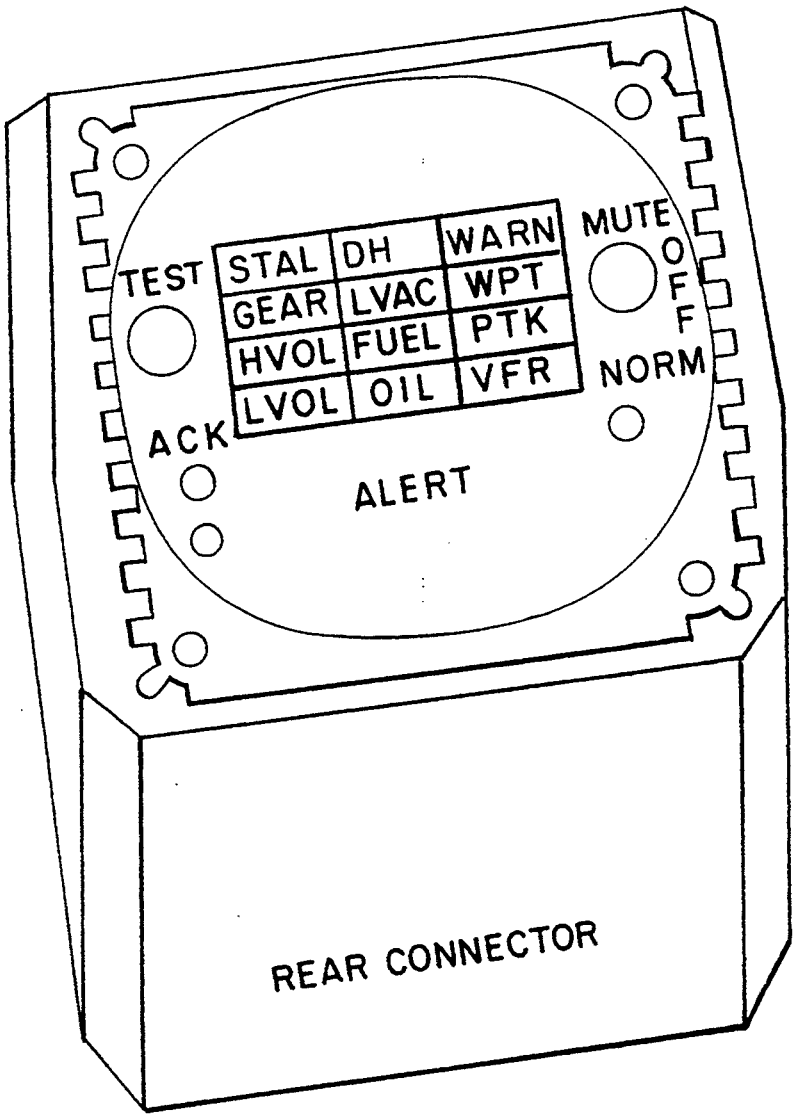
FIG. 1 is a perspective view of an annunciator system according to the present invention.
Figure 2:
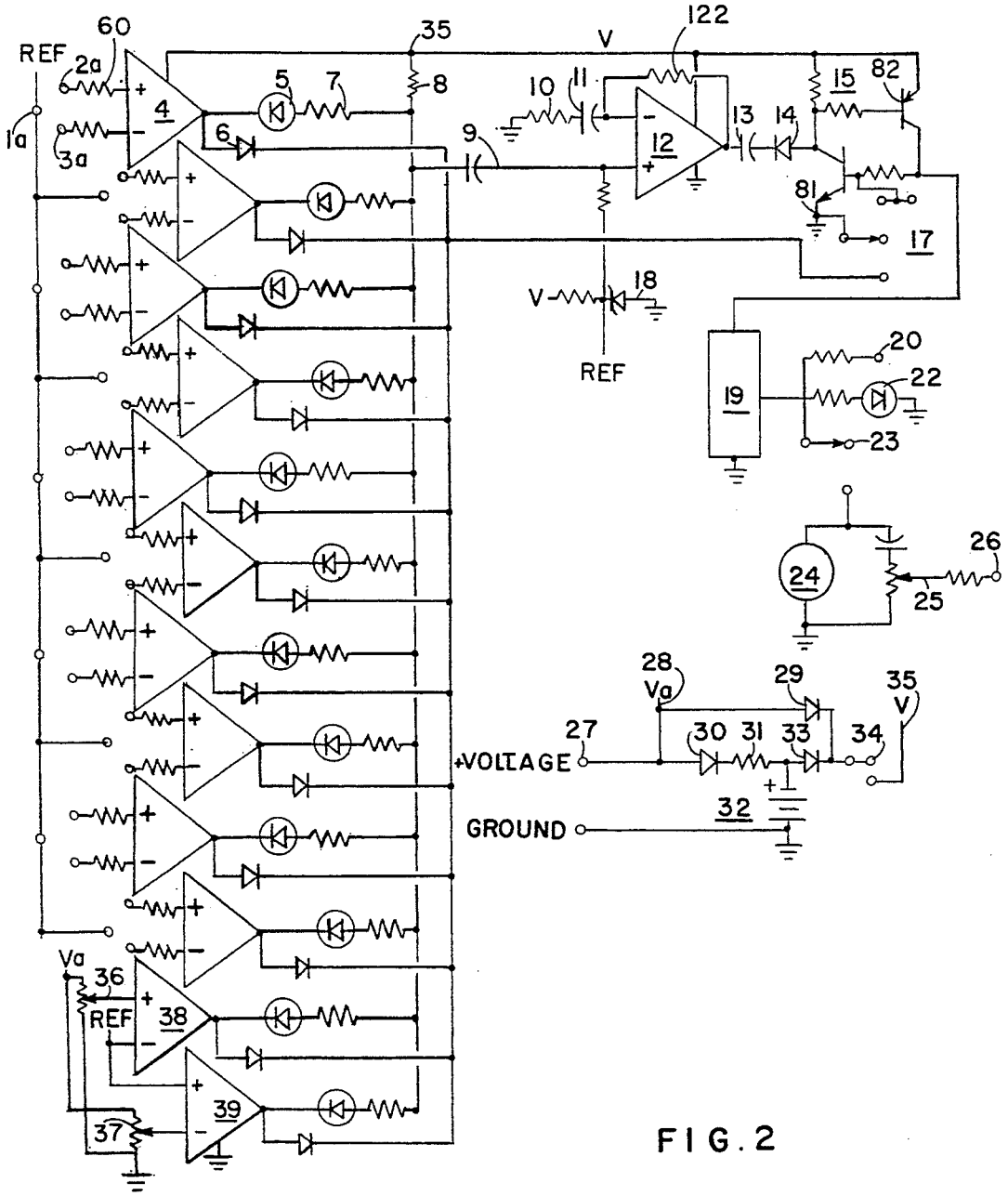
FIG. 2 is a electrical schematic diagram of the annunciator system of FIG. 1.
Figure 7:
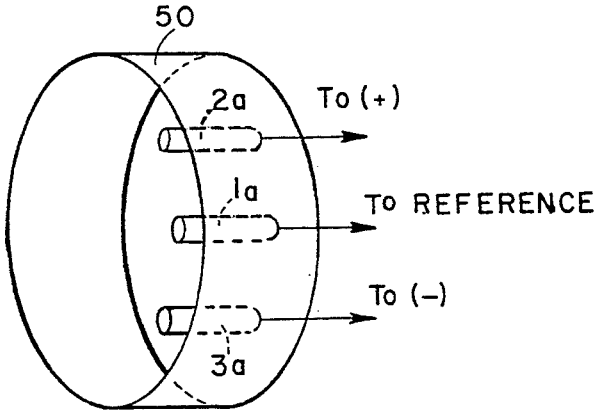
FIG. 7 is a perspective view of a rear connector according to the present invention.

FIG. 2 shows a plurality of comparators are used to monitor and compare the voltages monitored by the present invention. For every system monitored there is a mating connector 70 which is pre-wired to the system as shown in FIG. 6. Also, there is a corresponding comparator 4 for monitoring the system and each comparator 4 is connected to a rear-mounted connector 50 as shown in FIG. 7. The rear-mounted connector 50 is detachably engageable with the mating connector 70 for connecting the comparators 4 to the systems. The rear-mounted connector 50 also has pins or counterpins 1*a*, 2*a* and 3*a* for the reference voltage, positive voltage, and negative voltage respectively. Pins 1, 2 and 3 of connector 70 are joined to pins or counterpins 1*a*, 2*a* and 3*a* of connector 50 and aligned when the rear-mounted connector 50 is connected with the mating connector 70.

Each comparator 4 is connected to the rear-mounted connector 50 by connecting the positive input of comparator 4 to the positive voltage pin 2*a* of connector 50 and connecting the negative input of comparator 4 to the negative voltage or zero voltage pin 3*a* of the connector 50. The positive and negative inputs of comparator 4 are connected to pins 2*a* and 3*a* respectively through a resistor 60.

When a normal voltage emitting system, e.g. such as a landing gear is pre-wired to a mating connector 70 and further connected with a comparator 4 according to the present invention as described above, the voltage on pin 3 changes from ground to a positive voltage which can be 12 volts in a 12-volt aircraft. The voltage on pin 3 becomes greater than the reference voltage, which is usually one-half of the aircraft voltage, i.e., 6 volts, which is channeled through pin 2 due to jumper 55 connected to reference pin 1. Because there is a greater voltage through the negative or zero voltage pin 3, i.e., 12 volts, compared to the reference voltage of 6 volts which is channeled through pin 2, the comparator 4 changes its output to a zero voltage or as close as it can get to ground. The output by comparator 4 is sent to a title LED 5 causing the title LED 5 to illuminate through current supplied through resistor 8 and resistor 7. The current provided at resistors 8 and 7 is provided by operating voltage point 35, which supplies the operating voltage of the annunciator system. Output by comparator 4 is zero or very close to ground which causes the title LED 5 to become grounded.

The increase in current through resistor 8 causes a voltage drop across it, i.e., the voltage at the bottom of resistor 8 decreases. This decreasing voltage change is a negative-going spike that passes through capacitor 9 and into a non-inverting input of an operational amplifier 12.

Operational amplifier 12 can be a DC amplifier with a gain of unity or no gain because capacitor 11 is in the path from the inverting input to ground through resistor 10. Resistor 122 feeds the reference voltage into the non-inverting input, and therefore the output of the amplifier 12 normally has the same DC reference voltage. However, the amplifier 12 has a higher-than-unity gain for AC signals. In the alert state, the negative-going spike fed into the non-inverting input is amplified and becomes a much larger negative-going spike at the output of the amplifier 12. Capacitor 13 and diode 14 pass this spike into multivibrator 15, consisting of two transistors 81 and 82.

In the non-alert state, transistors 81 and 82 are turned off, that is, non-conducting. When the negative-going spike occurs, current is allowed to pass through the emitter and the base of transistor 82, which turns transistor 82 on. Transistor 82 allows a much larger current to flow from its emitter into its collector, supplying current to the base of transistor 81 for turning on, as well as activating an oscillator 19. A continual drain of current from the base of transistor 82 keeps it operating, while transistor 81 is on.

Oscillator 19, which can be typically a 555-type IC, starts to oscillate with a square wave, on and off. This square wave is fed to a built-in main LED 22, to a remotely-located LED in front of the pilot through remote output pin 20, and to an audio on-off switch 23. If the switch 23 is on, which can be the lower position, audio beeper 24 is sounded, and a clicking signal is fed through potentiometer 25 and remote headset output 26 to the pilot's headphones. The square wave output of the oscillator 19 creates a distinctive clicking sound in the headphones and the volume is adjustable by the potentiometer 25. If the audio on-off switch 23 is in the off position, the beeping and clicking is silenced, but the title LEDs 5 is still illuminated and the main and remote LEDs (22 and at 20) still flash.

Upon seeing the alert, the pilot pushes a test/acknowledge switch 17 to the up position momentarily. This turns off transistor 81 which no longer supplies a ground for the current from transistor 82. Thus, transistor 82 is turned off and the multivibrator 15 is reset. Once reset, the oscillator 19 is no longer supplied voltage and the beeping and flashing of the main and remote LEDs 22 stop. However, the title LED 5 that was originally illuminated will remain lit until the input signal to the comparator 4 changes back to ground. Once the test/acknowledge switch 17 is released, and is in its normal center position, the multivibrator 15 is free to be triggered by any new alerts that are generated.

Once the pilot takes corrective action, i.e., by lowering the landing gear, the input signal to the comparator 4 changes back to ground, signifying an end to the alert, and the illumination of the title LEDs is terminated. The change in current at the bottom of resistor 8 causes a positive-going spike. A positive-going spike will not pass through diode 14 and thus will not trigger the multivibrator 15 to start beeping and flashing. Thus, the pilot does not have to reacknowledge the problem when it is corrected.

In the second type of alert signal, the connections of the positive terminal 2 and the negative terminal 3 are reversed, but all other operation of the invention remains the same.

The present invention allows the pilot to test the operation of the unit without one of the systems and sensors malfunctioning. The pilot can throw the test/acknowledge switch 17 to the bottom position for testing by grounding diodes 6 which provides a means to light all title LEDs 5, as well as trigger the beeping and flashing of the main and remote LEDs 22 as described above.

Power is supplied from a+voltage Va at 28 of the aircraft through a power input terminal 27. Rechargeable battery 32 is constantly charged by the voltage from the aircraft, limited to a trickle by resistor 31. Diode 30 prevents the battery from being drained when the aircraft is turned off. Diode 29 and diode 33 supply either aircraft or battery voltage, whichever is higher, to power switch 34. When power switch 34 is in the down position, the system is on, and voltage is supplied through voltage point 35, which powers all the circuitry in the system.

A zener diode 18 sets the reference voltage, which, channeled through pins 1 and 1*a*, is used for all of the input comparators 4 as well as for voltage sensor comparators 38 and 39. This reference voltage is approximately 6 volts for a 12 volt aircraft, and 12 volts for a 24 volt aircraft.

The aircraft voltage 28 (Va) is supplied to the two comparators 38 and 39 dedicated to high and low voltage indications. Potentiometers 36 and 37 pick the exact voltage at which these indications will be illuminated. If aircraft voltage 28 goes too high, the negative terminal on comparator 39, after being fed a portion of that voltage from potentiometer 37, will have a higher voltage on it than will the positive input from the reference. If this occurs, the high voltage comparator 39 will drop to ground and this will illuminate its title LED 5 which can be labeled "HVOL" for indicating a high voltage.

If the aircraft voltage 28 gets too low, the portion of that voltage set by potentiometer 36 will become less than that on the positive input of comparator 38. Then the comparator 38 output will become ground and the title LED 5 will light a low voltage label, i.e., "LVOL".

FIG. 2 shows a total of twelve comparators 4. The first ten comparators 4 are identical to the comparator function 26 described earlier, and the last two comparators 38 and 39 are dedicated for high and low voltage. For each of the comparators 4, 38 and 39, two inputs 2*a* and 3*a* and a reference pin 1*a* are shown in a triangular arrangement on the rear connector 50 which is identical to the actual pin arrangement 1, 2 and 3 on the mating connector 70.

Figure 3:
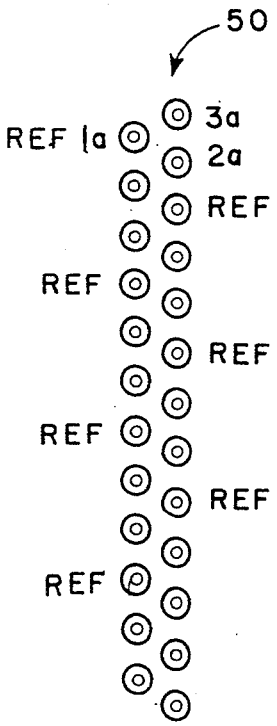
FIG. 3 is a schematic diagram of a connector pin assignment of the annunciator system of FIG. 1.

FIG. 3 shows the pin arrangement of the rear connector 50. The wiring of the mating connector 70 is made according to this arrangement. The reference voltage appears on pin 1*a*. This creates a triangular pattern for each of five comparators 4.

Figure 4:
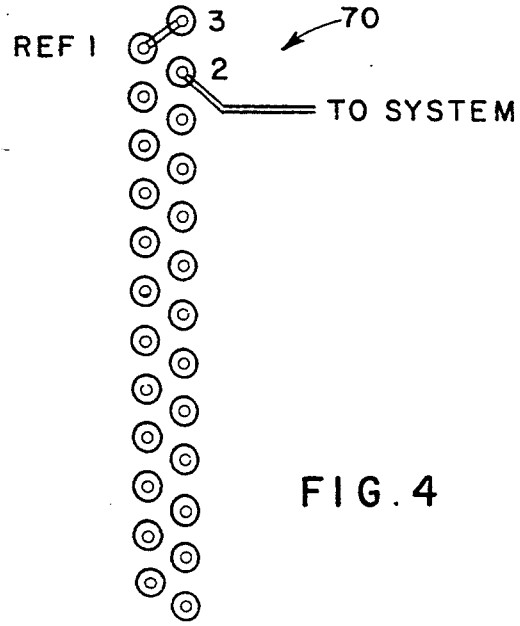
FIG. 4 is a schematic diagram of one embodiment of a mating connector according to the present invention.
Figure 5:
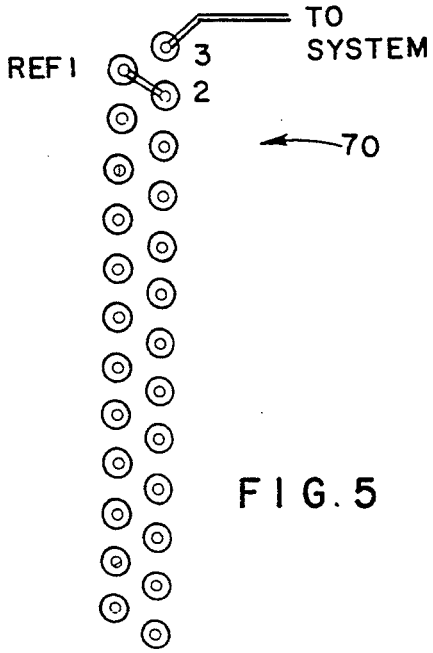
FIG. 5 is a schematic diagram of a second embodiment of a mating connector according to the present invention.

FIG. 4 shows reference pin 1 jumpered to pin 3, and pin 2 is connected to the system or sensor for the first comparator 4. In FIG. 5, reference pin 1 is jumpered to pin 2, and pin 3 is connected to the system or sensor for the first comparator 4. This illustrates the two ways of configuring the comparator 4 for either ground or high voltage alerts.

While a specific embodiment of the invention has been shown and described in detail to illustrate the application of the principles of the invention, it will be understood that the invention may be embodied otherwise without departing from such principles.

What is claimed is:

1. An apparatus for monitoring a plurality of sensors of an aircraft, the aircraft having an operating voltage and a ground voltage, some of the sensors being positive sensors and emitting a positive voltage as an alert signal, and some of the sensors being ground sensors and emitting a ground voltage as an alert signal, the apparatus comprising:

a separate mating connector connected to each sensor of the aircraft to be monitored, each mating connector having a positive voltage pin, a ground voltage pin and a reference voltage pin, the pins being fixed in a triangular arrangement with each pin at a different apex of the triangular arrangement, each mating connector which is connected to a positive sensor being pre-wired to the positive sensor at the ground voltage pin and forming a positive mating connector, each mating connector which is connected to a ground sensor being pre-wired to the ground sensor at the positive voltage pin and forming a ground mating connector;

a separate jumper in each mating connector, each jumper being connected between the reference voltage pin and the positive voltage pin in each positive mating connector, and between the reference voltage pin and the ground voltage pin in each ground mating connector;

a separate rear connector for each mating connector, each rear connector having a positive voltage counterpin, a ground voltage counterpin and a reference voltage counterpin, the counterpins being fixed in a triangular arrangement corresponding to the triangular arrangement of the mating connector pins, each rear connector being removably engageable with a respective pre-wired mating connector such that the positive voltage pin, the ground voltage pin and the reference voltage pin of each respective mating connector aligns with and is engaged to a respective positive voltage counterpin, ground voltage counterpin and reference voltage counterpin of the rear connector;

all of the reference voltage counterpins being connected together and being connected to a reference voltage, the reference voltage being less than the positive voltage emitted by the positive sensors as the alert signal, and the reference voltage being channeled from the reference voltage pins to the positive voltage pins through the jumpers of respective positive mating connectors, the reference voltage being channeled from the reference voltage pins to the ground voltage pins through the jumpers of respective ground mating connectors;

a voltage comparator connected to each rear connector, each voltage comparator having a positive input connected to the positive voltage counterpin of a respective rear connector, and a negative input connected to the ground voltage counterpin of a respective rear connector, each individual voltage comparator operating to monitor an alert signal from the sensor which is pre-wired to the mating connector that is aligned with and engaged to the rear connector of that individual voltage comparator, each voltage comparator receiving and comparing the alert signal from a respective sensor to the reference voltage from the respective rear connector, the reference voltage being provided to the voltage comparator through a respective jumper being connected to either the positive voltage pin or the ground voltage pin of a respective mating connector, which in turn is connected to a positive voltage counterpin or a negative voltage counterpin of a respective rear connector, each voltage comparator which is connected to a positive sensor generating an output signal when a voltage received at the negative input exceeds the reference voltage, and each voltage comparator which is connected to a ground sensor generating an output signal when a voltage received at the positive input is less than the reference voltage;

a separate title display for each voltage comparator, each title display being connected to receive an output signal from a respective voltage comparator to be activated upon the occurrence of an output signal for producing a warning when an alert signal has occurred; and alarm means connected to all of the voltage comparators for activating an alarm when any of the voltage comparators produces an output signal.

2. The apparatus according to claim 1, wherein the reference voltage comprises a power source.

3. The apparatus according to claim 2, wherein the power source is a rechargeable battery.

4. The apparatus according to claim 3, wherein the battery is connected to the operating voltage of the aircraft for being charged by the aircraft.

5. The apparatus according to claim 1, wherein the reference voltage is about one half of the positive voltage emitted by the positive sensors.

6. The apparatus according to claim 5, wherein the positive voltage emitted by the positive sensors is the operating voltage of the aircraft.

7. The apparatus according to claim 5, wherein the reference voltage is set by a zener diode.

8. The apparatus according to claim 1, including two system voltage comparators operatively connected to the operating voltage of the aircraft, one system voltage comparator having a positive voltage input connected with the operating voltage of the aircraft, and a zero voltage input connected with the reference voltage, the other system voltage comparator having a positive voltage input connected with the reference voltage and a zero voltage input connected with the operating voltage of the aircraft, the one system voltage comparator for monitoring a low voltage condition for the aircraft and the other system voltage comparator for monitoring a high voltage condition for the aircraft.

9. The apparatus according to claim 1, wherein the title display and the alarm means include light-emitting diodes.

* * * * *